US012551082B2

(12) United States Patent
Kim et al.

(10) Patent No.: US 12,551,082 B2
(45) Date of Patent: Feb. 17, 2026

(54) TUMBLER CLEANER

(71) Applicant: DOLPHIN CO., LTD., Gyeonggi-do (KR)

(72) Inventors: Tae Hun Kim, Gyeonggi-do (KR); Tae Jun Kim, Gyeonggi-do (KR)

(73) Assignee: DOLPHIN CO., LTD., Gyeonggi-do (KR)

( * ) Notice: Subject to any disclaimer, the term of this patent is extended or adjusted under 35 U.S.C. 154(b) by 89 days.

(21) Appl. No.: 18/646,778

(22) Filed: Apr. 26, 2024

(65) Prior Publication Data

US 2024/0268625 A1 Aug. 15, 2024

Related U.S. Application Data

(63) Continuation of application No. PCT/KR2021/017568, filed on Nov. 25, 2021.

(30) Foreign Application Priority Data

Nov. 3, 2021 (KR) ..... 10-2021-0149378
Nov. 3, 2021 (KR) ..... 10-2021-0149379
Nov. 3, 2021 (KR) ..... 10-2021-0149381

(51) Int. Cl.

| | |
|---|---|
| ***A47L 15/00*** | (2006.01) |
| ***A47L 15/30*** | (2006.01) |
| *A47L 15/14* | (2006.01) |
| *A47L 15/42* | (2006.01) |

(52) U.S. Cl.

CPC ..... *A47L 15/0065* (2013.01); *A47L 15/30* (2013.01); *A47L 15/0089* (2013.01); *A47L 15/14* (2013.01); *A47L 15/4257* (2013.01)

(58) Field of Classification Search

CPC .. A47L 15/30; A47L 15/0065; A47L 15/4257; A47L 15/0089; A47L 15/14

See application file for complete search history.

(56) References Cited

U.S. PATENT DOCUMENTS 378,621 A * 2/1888 Rowe ..... A47L 15/0065 134/55
622,446 A * 4/1899 Clute ..... A47L 15/0068 15/159.1

(Continued)

FOREIGN PATENT DOCUMENTS

CN 110573053 A * 12/2019
CN 111482421 A 8/2020

(Continued)

OTHER PUBLICATIONS

WIPO, International Search Report and Written Opinion for International Application No. PCT/KR2021/017568, Jul. 19, 2022.

*Primary Examiner* — Benjamin L Osterhout
(74) *Attorney, Agent, or Firm* — Nicholas Park

(57) ABSTRACT

A tumbler cleaner according to an embodiment of the present invention comprises a housing; a door coupled to a front opening of the housing; a bracket attached to an inner side of the door; a cleaning unit coupled to the bracket and cleaning each of a cup and a lid of a tumbler; and one or more nozzles disposed in at least one of an upper portion and lower portion of the housing to spray washing water and rinsing water toward the cleaning unit.

8 Claims, 17 Drawing Sheets

(56) References Cited

U.S. PATENT DOCUMENTS 1,087,260 A * 2/1914 Rogers ..... A47L 15/0065 134/55
1,186,313 A * 6/1916 Harries ..... A47L 15/0068 15/75
1,838,940 A * 12/1931 Griffiths ..... A47L 15/0065 137/893
2,032,013 A * 2/1936 Griffiths ..... A47L 15/0068 15/101
2,104,272 A * 1/1938 Partridge ..... A47L 15/0068 15/76
2,158,904 A * 5/1939 Meeker ..... A47L 15/0068 15/76
2,213,918 A * 9/1940 Lofstrand, Jr. ..... A47L 15/0065 206/427
2,263,807 A * 11/1941 Hanson ..... A47L 15/0068 15/75
2,268,721 A * 1/1942 Ossowsky ..... B08B 9/36 134/55
2,339,832 A * 1/1944 Arnold ..... A47L 15/0068 15/75
2,573,945 A * 11/1951 Anstice, Sr. ..... A47L 15/0068 15/101
2,599,455 A * 6/1952 Husemann ..... A47L 15/245 198/848
2,631,313 A * 3/1953 Webber ..... A47L 15/0068 15/75
2,665,440 A * 1/1954 Starcevich ..... A47L 15/0065 134/55
2,772,429 A * 12/1956 Lyman ..... A47L 15/0068 15/76
3,043,724 A * 7/1962 Balshaw ..... A47L 15/0065 134/143
3,044,092 A * 7/1962 Fox ..... A47L 15/4418 134/103.2
3,731,696 A * 5/1973 Hackney ..... A47L 15/0065 134/152
3,781,939 A * 1/1974 Qualheim ..... A47L 15/0068 15/76
4,431,015 A * 2/1984 Noren ..... A47L 15/0065 134/55

FOREIGN PATENT DOCUMENTS

DE 4233934 A1 * 4/1994 ..... A47L 15/0065
DE 19708805 A1 * 10/1997 ..... A47L 15/507
EP 0593876 A1 4/1994
GB 193733 A * 3/1923 ..... A47L 15/0065
GB 402491 A * 12/1933 ..... A47L 15/0068
GB 479142 A * 2/1938 ..... A47L 15/0065
GB 479786 A * 2/1938 ..... A47L 15/0068
GB 634315 A * 3/1950 ..... A47L 15/0065
GB 681475 A * 10/1952 ..... A47L 15/0065
GB 1034952 A * 7/1966 ..... A47L 15/39
JP 2013523373 A1 6/2013
JP 2015205150 A 11/2015
KR 20-0114028 Y1 4/1998
KR 20-0346047 Y1 3/2004
KR 10-2011-0096607 A 8/2011
KR 10-1166436 B1 7/2012
KR 20-2013-0005454 U 9/2013
KR 10-1970520 B1 4/2019
KR 20190119367 A * 10/2019 ..... A47L 15/13
KR 102052837 B1 * 12/2019 ..... A47L 15/13
KR 10-2114048 B1 5/2020
KR 102141318 B1 * 8/2020 ..... A46B 13/023
WO WO-2022203102 A1 * 9/2022 ..... A47L 15/0065

* cited by examiner

TUMBLER CLEANER

CROSS-REFERENCE TO RELATED APPLICATION

This application is a US Bypass Continuation Application of International Application No. PCT/KR2021/017568, filed on Nov. 25, 2021, which claims priority to and the benefit of Korean Patent Application No. 10-2021-0149378, filed on Nov. 3, 2021, Korean Patent Application No. 10-2021-0149379, filed on Nov. 3, 2021, and Korean Patent Application No. 10-2021-0149381, filed on Nov. 3, 2021, the disclosure of which is incorporated herein by reference in its entirety.

BACKGROUND

Technical Field

The present invention relates to a tumbler cleaner and, more particularly, to a tumbler cleaner automatically washing and rinsing a cup, a lid, and a straw of a tumbler in a disassembled state of the tumbler.

Background Art

In general, use of personal cups, i.e., tumblers, in coffee shops and the like, are rapidly increasing to reduce environmental pollution caused by disposable cups. A tumbler includes a cup and a lid covering an opening of the cup to protect a beverage filled in the cup, and the tumbler may keep the beverage warm and cold. A cup and a lid having a straw designated for a tumbler are sold as a set, which is widely purchased for personal use.

Filled with any beverages provided or sold in a public facility or a store specializing in selling beverages, the tumbler being portable may be repeatedly used throughout a period of time, e.g., a day. For this reason, it is essential to cleanly wash the tumbler and manage hygiene of the tumbler. As the tumbler generally has a small diameter and a large depth, it is difficult to wash the tumbler compared to general tableware or containers.

Conventionally, only the cup of the tumbler is washed with other food containers using a dishwasher. However, a device simultaneously cleaning the cup, the lid, and the straw in places, like public facilities or beverage specialty shops, is not present.

For this reason, a user needs to personally clean the cup to use the tumbler. However, it is difficult for the user to clean the cub due to the shape of the tumbler having a small diameter and a large depth. In addition, there has been a hygiene issue with management of the tumbler.

SUMMARY

Technical Problem

Embodiments of the present invention have been made in an effort to solve the above-mentioned problems.

An objective of the present invention is to provide a tumbler cleaner that may be simply mounted with a cup, a lid, and a straw for tumblers and wash and rinse the cup, the lid, and the straw for tumblers to allow a user to keep a tumbler clean at all times and to repeatedly use the tumbler.

An objective of the present invention is to provide a tumbler cleaner to be used in places, such as a public facility or a store specializing selling drinks, which enables a user to clean a tumbler conveniently, simply, and quickly before obtaining a drink in the places.

An objective of the present invention is to provide a tumbler cleaner that provides a courtesy service and promotes selling through hygiene management offered by the tumbler cleaner.

An objective of the present invention is to provide a tumbler cleaner having excellent safety by preventing hot water remaining on a ceiling of the tumbler cleaner from dropping onto a hand of a user when the user takes out a cleaned tumbler from the tumbler cleaner, thereby blocking in advance injuries or discomfort to the user.

Technical Solutions

In order to achieve the objectives, the present invention provides a tumbler cleaner comprises a housing; a door coupled to a front opening of the housing; a bracket attached to an inner side of the door; a cleaning unit coupled to the bracket and cleaning each of a cup and a lid of a tumbler; and one or more nozzles disposed in at least one of an upper portion and lower portion of the housing to spray washing water and rinsing water toward the cleaning unit.

In an embodiment, the cleaning unit may include a lid chamber accommodating the lid of the tumbler; and a cup receiver, wherein the cup of the tumbler is mounted on the cup receiver.

In an embodiment, the lid chamber and the cup receiver may operate in conjunction with each other by a power transfer means.

In an embodiment, the cup receiver may be arranged in a support body attached to the bracket to axially rotate in a direction perpendicular to the support body, and wherein gear teeth are formed on a lower outer circumferential face of the cup receiver along a circumferential direction of the cup receiver.

In an embodiment, the power transfer means may include a first pulley coupled at one side of the lid chamber; a second pulley disposed at one side of the cup receiver to be axially rotatable in a direction perpendicular to a rotation direction of the cup receiver, wherein cogs being in gear engagement with the gear teeth are formed on a circumferential face of the second pulley; and a belt connected to each of the first pulley and the second pulley to transfer power.

In an embodiment, the cleaning unit may further include a coil spring for inserting a straw, vertically disposed by a support fixture coupled to the bracket.

In an embodiment, the lid chamber may include two support circular plates disposed to face with each other; a plurality of hinge shafts disposed between the two support circular plates; and a plurality of openable plates, each having an arc shape, wherein the plurality of openable plates is hingedly coupled to the plurality of hinge shafts to be rotatable, and wherein a plurality of openings may be formed to allow a flow of the washing water and the rinsing water into the plurality of openable plates.

In an embodiment, each openable plate in the plurality of openable plates may have a shape of a quadrant arc shape, wherein the lid chamber may be formed as a cylinder by four openable plates coupled to each other, wherein a hinge portion coupled to a hinge shaft in the plurality of hinge shafts may be provided at one side of the openable plate, and wherein a wing portion contacting an outer side of an adjacent hinge shaft may be integrally formed at the other side of the openable plate.

In an embodiment, the plurality of openable plates may be coupled to the plurality of hinge shafts such that an elastic force is applied in an opening direction of the plurality of openable plates by torsion springs disposed in the plurality of hinge shafts, wherein the plurality of openable plate may be contacted by a plurality of guide rollers fixedly positioned in the bracket to stay closed, except for an upper direction of the door.

In an embodiment, locking grooves may be formed in the support circular plates, wherein each locking groove may have multiple portions that are spaced apart in a circumference direction of the locking groove such that the elastic force is adjusted based on a locking location of an end of the torsion springs.

In an embodiment, the cup receiver may include a mount member having a cone shape, wherein a diameter of an upper end portion of the mount member may be smaller than a diameter of a lower end portion of the mount member, wherein gear teeth may be formed on a lower circumference of the mount member along a circumferential direction of the mount member, and wherein a plurality of drain holes may be formed in the mount member.

In an embodiment, a receiving protrusion may obliquely protrude from an outer inclined surface of the mount member to form a space between the inclined surface and an inner surface of the cup of the tumbler mounted thereon.

In an embodiment, the cup receiver may further include a support rod coupled to an upper center portion of the mount member; and a cup support coupled to an upper end of the support rod.

DETAILED DESCRIPTION

The appended drawings and embodiments described in detail herein will make clear the advantages and features of the present invention, as well as methods to achieve them. However, the present invention is not limited to the disclosed embodiments below. Various forms may be obtained, and various modifications can be applied. The embodiments used herein are merely to complete the disclosure of the present invention and are provided to fully inform one having ordinary skill in the art of the scope of the present invention. The present invention is only defined by the scope of the claims.

Also, terms used herein are only to explain embodiments but not to limit the present invention. A singular representation may include a plural representation unless a clearly different meaning can be grasped from the context. Used herein, terms, such as "comprise," "include," and "have," do not exclude presence of other elements other than mentioned elements.

Unless defined differently, terms including technical and scientific terms, used herein, may be used to have a meaning commonly understood by one having ordinary skill in the art. In order to describe the present invention in detail, example embodiments of the present invention are described in detail with reference to the appended drawings.

FIGS. 1 to 17 illustrates a tumbler cleaner according to an embodiment of the present invention. A tumbler includes a cup and a lid covering an upper opening of the cup to protect a beverage therein. Recently, a cup and lid having a straw designated for the tumbler are sold as a set, which is widely purchased for personal use. As an example, a tumbler cleaner according to the present invention is a device that can be installed in public facilities or stores specializing in selling beverages to allow a user to cleanly and automatically clean the cup, the lid, and the straw right before the user gets a drink in the tumbler.

Figure 1:
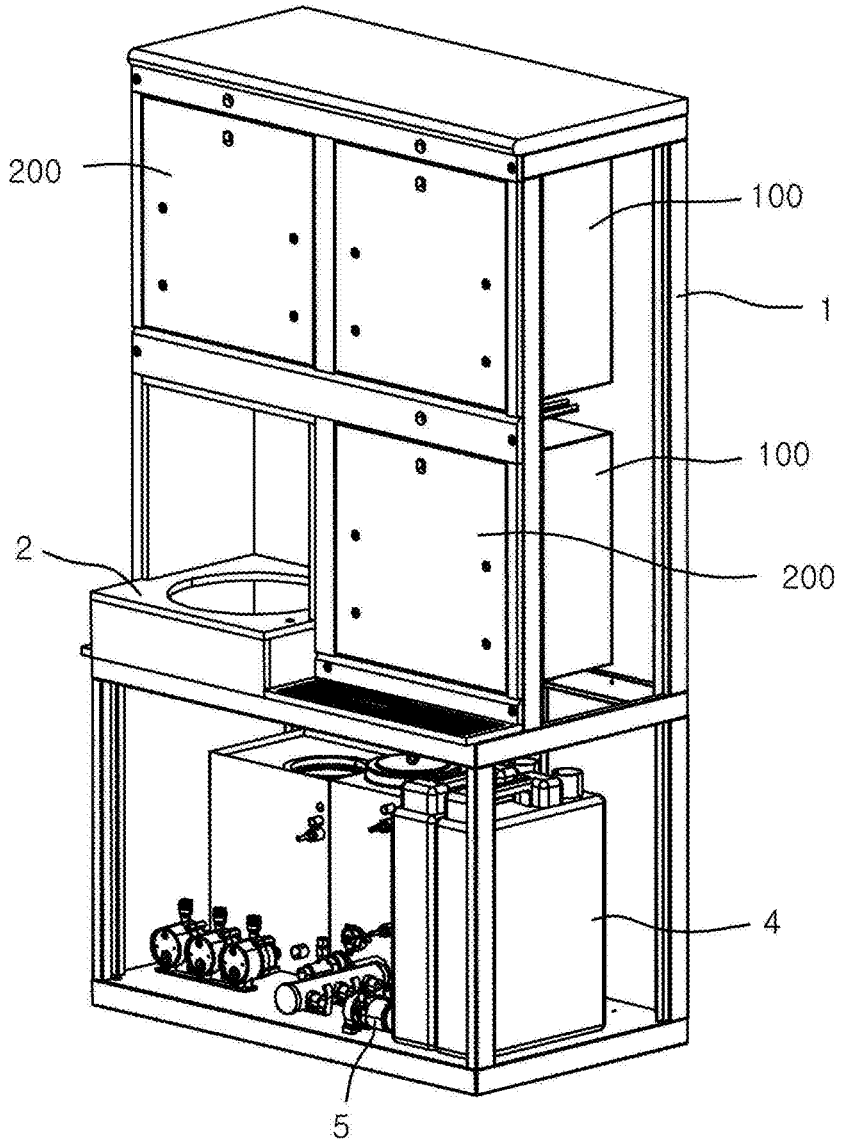
FIG. 1 is a perspective view illustrating a state in which a tumbler cleaner according to the present invention is arranged in a frame having a cabinet structure.
Figure 2:
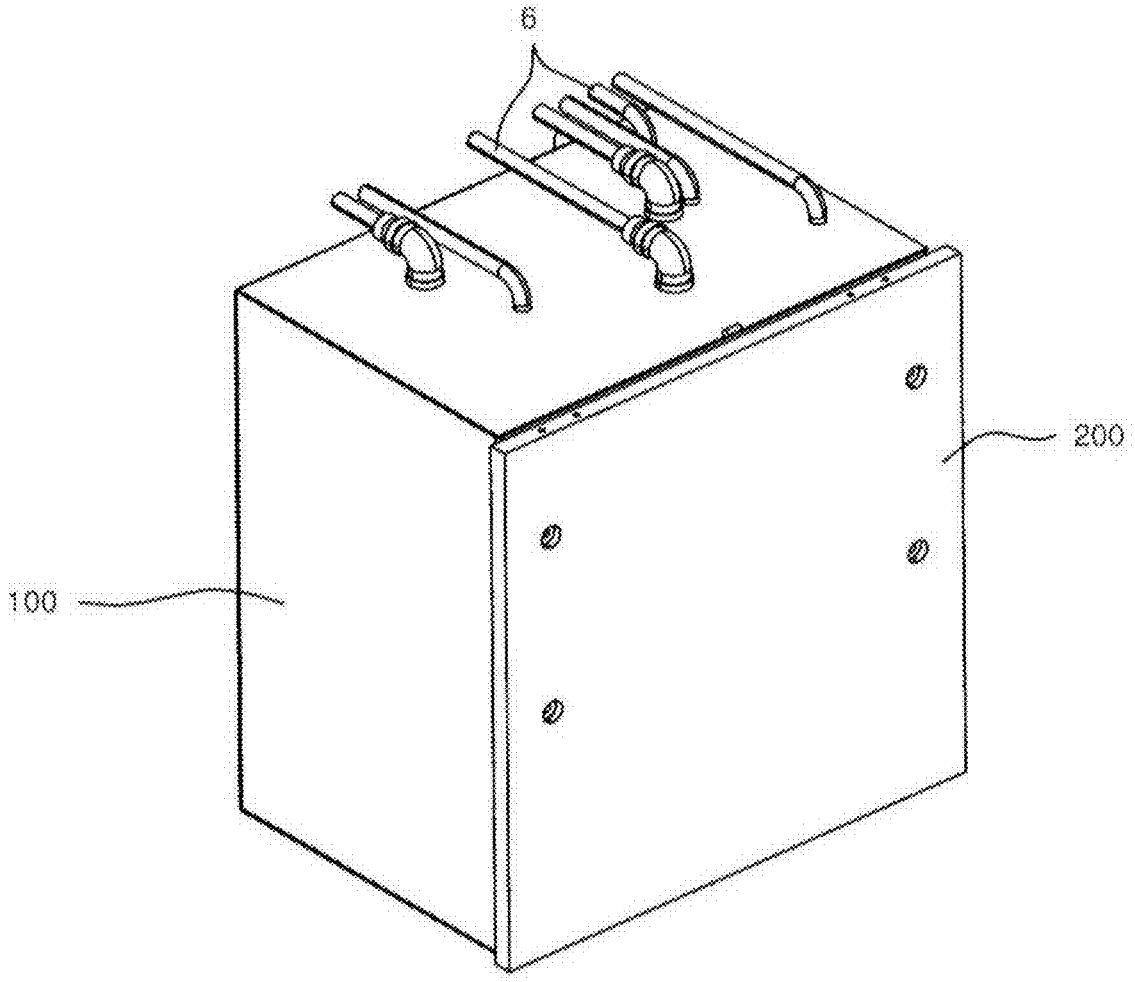
FIG. 2 depicts an outer shape of a tumbler cleaner according to the present invention.
Figure 3:
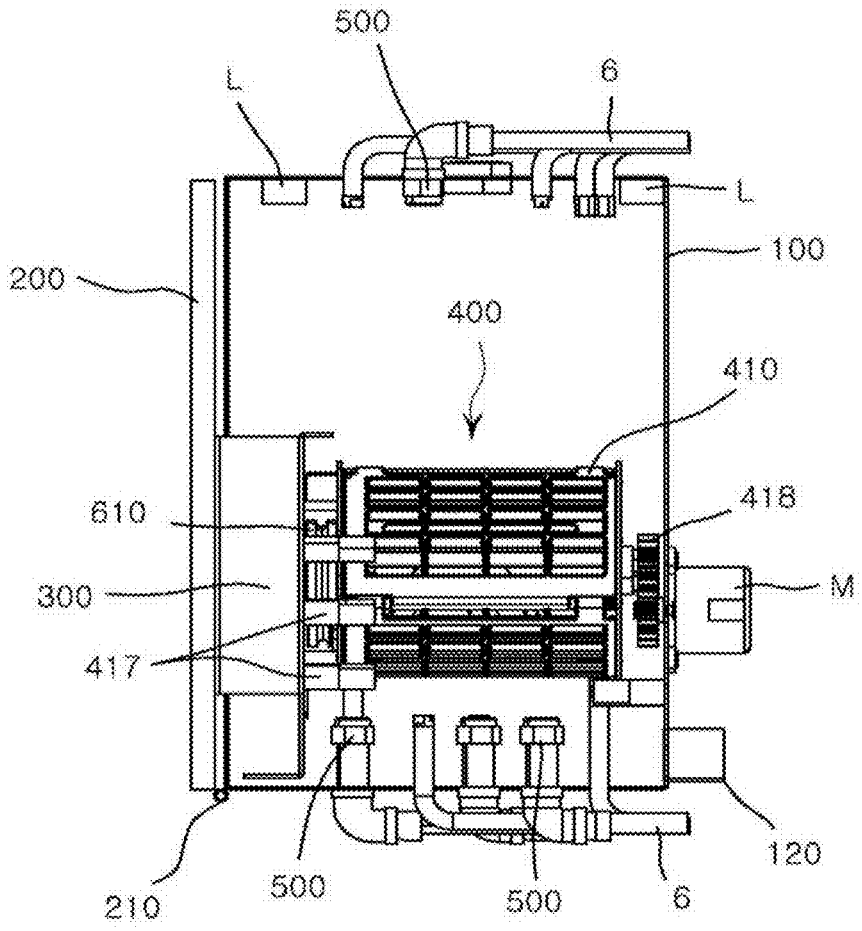
FIG. 3 is a longitudinal cross-sectional view showing a state in which a door is closed against an opening portion of a housing.
Figure 4:
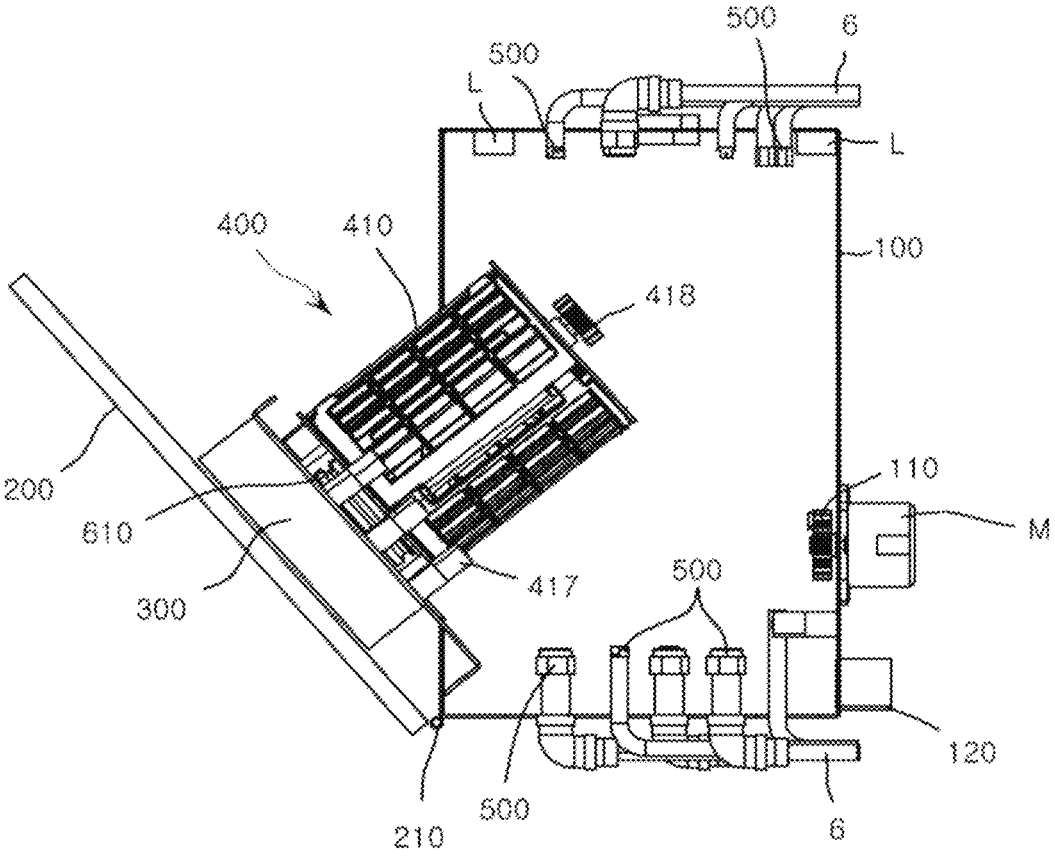
FIG. 4 is a longitudinal cross-sectional view showing a state in which a door is opened from an opening portion of a housing.
Figure 5:
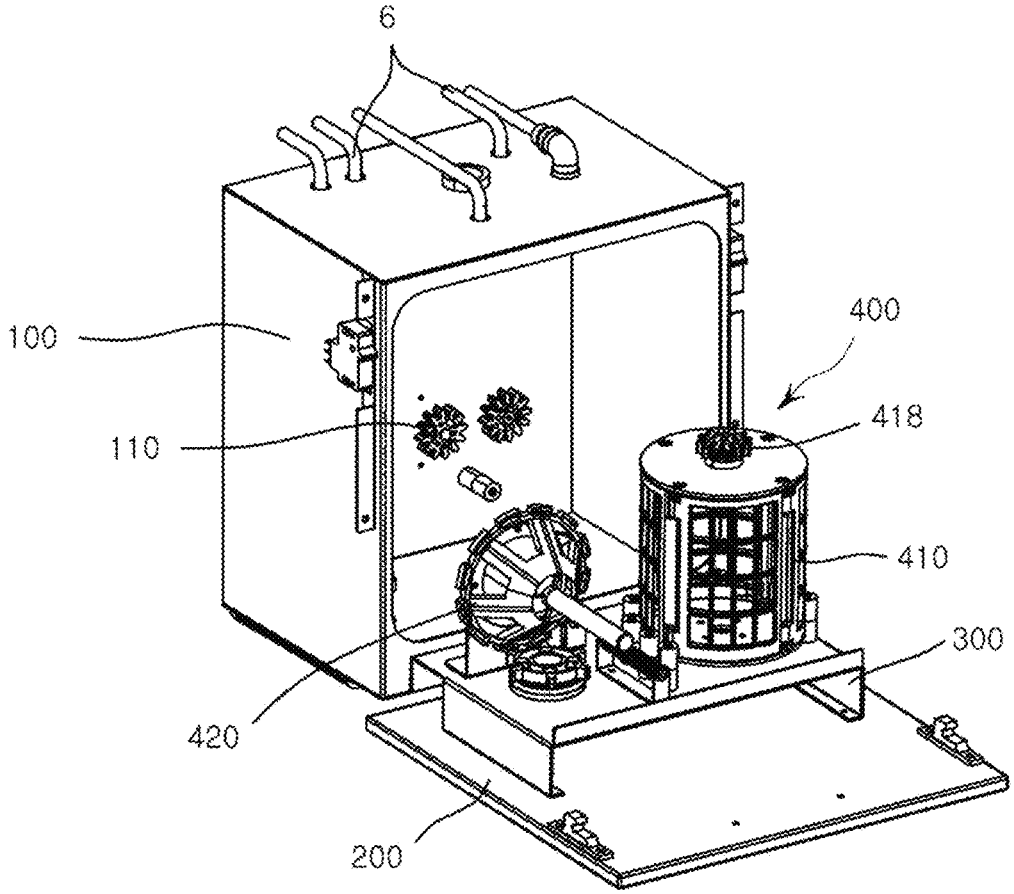
FIG. 5 is a perspective view showing a state in which a door is fully opened from a housing.

FIG. 2 depicts an outer shape of a tumbler cleaner according to an embodiment, and FIG. 3 is a longitudinal cross-sectional of the tumbler cleaner when a door 200 is closed. FIG. 4 is a longitudinal cross-sectional view showing a cleaning unit 400 attached through a bracket 300 to the door 200 rotates together with the door 200 to allow a user to mount a cup, lid, and straw to the cleaning unit 400 when the door 200 is open or showing the cup, the lid, and the straw can be taken out after washing is complete, and FIG. 5 illustrates a state where the door 200 is fully open from a housing 100.

A tumbler cleaner according to an embodiment of the present invention comprises a housing 100, a door 200, a bracket 300, a cleaning unit 400, one or more nozzles 500, or the like. The housing 100 defining a case has a shape of a rectangular enclosure with an empty space therein, for example. A front side of the housing 100 may be open. The housing 100 provides a space in which components stored in the housing 100 may be washed and rinsed.

The door 200 is rotationally coupled through a hinge 210 to an opening in the front side of the housing 100 according to an embodiment. In another embodiment, the door (not shown) may slidingly move such that the door 200 may be drawn in or out in front and rear directions through the opening in the front side of the housing 100. The cleaning unit may be rotational within a preset angle range according to the slide movement of the door.

The door 200 may have a plate shape and a preset thickness. A center portion of the door 200 may be formed of transparent glass or acrylic material such that the inside of the housing 100 can be visible to show the washing and rinsing from outside. In addition, a locking device may be provided to prevent the door 200 from accidentally opening in a state where the door 200 is closed for washing and rinsing. The bracket 300 is attached to an inner side of the door 200.

The cleaning unit 400 is coupled to the bracket 300. The cleaning unit 400 is configured to wash each of the cup and the lid of the tumbler. In an embodiment, the cleaning unit 400 is fixedly installed through the bracket 300 attached to the inner side of the door 200, and the cleaning unit 400 may rotate together in the preset angle range with rotation of the door 200 (Refer to FIGS. 4 and 5). This may prevent injury or discomfort which may be caused by hot water remaining on an inner ceiling of the housing 100, falling when the tumbler is taken out after the cleaning process is finished.

One or more nozzles 500 are disposed in at least a part of an upper portion or a lower portion of the housing 100 to spray each of washing water and rinsing water toward the cleaning unit 400. In an embodiment, the one or more nozzles 500 may include a plurality of nozzles. The washing water and the rinsing water sprayed by the one or more nozzles 500 may be obliquely sprayed.

The cleaning unit 400 may accommodate each of the cup, the lid, or the straw in the tumbler to be washed and rinsed by the one or more nozzles 500. The cleaning unit 400 may include a lid chamber 410 in which the lid of the tumbler is placed. The cleaning unit 400 may include a cup receiver 420 in which the cup of the tumbler is placed. Additionally, the cleaning unit 400 may include the lid chamber 410 stowing the lid of the tumbler and the cup receiver 420 stowing the cup of the tumbler. In an embodiment, the lid chamber 410 and the cup receiver 420 may operate in conjunction with each other by a power transfer means 600.

The cleaning unit 400 may further include a coil spring 430 for inserting a straw, disposed in a vertical direction by a support fixture 431 coupled to the bracket 300. When a personal straw is inserted into the coil spring 430 for inserting a straw, the cleaning water and the rinsing water from the one or more nozzles 500 may enter through gaps in the coil spring 430 and contact the straw, thereby effectively washing and cleaning the straw. The support fixture 431 supports a lower end of the straw inserted into the coil spring 430 for inserting a straw, which prevents the straw from falling.

Figure 11:
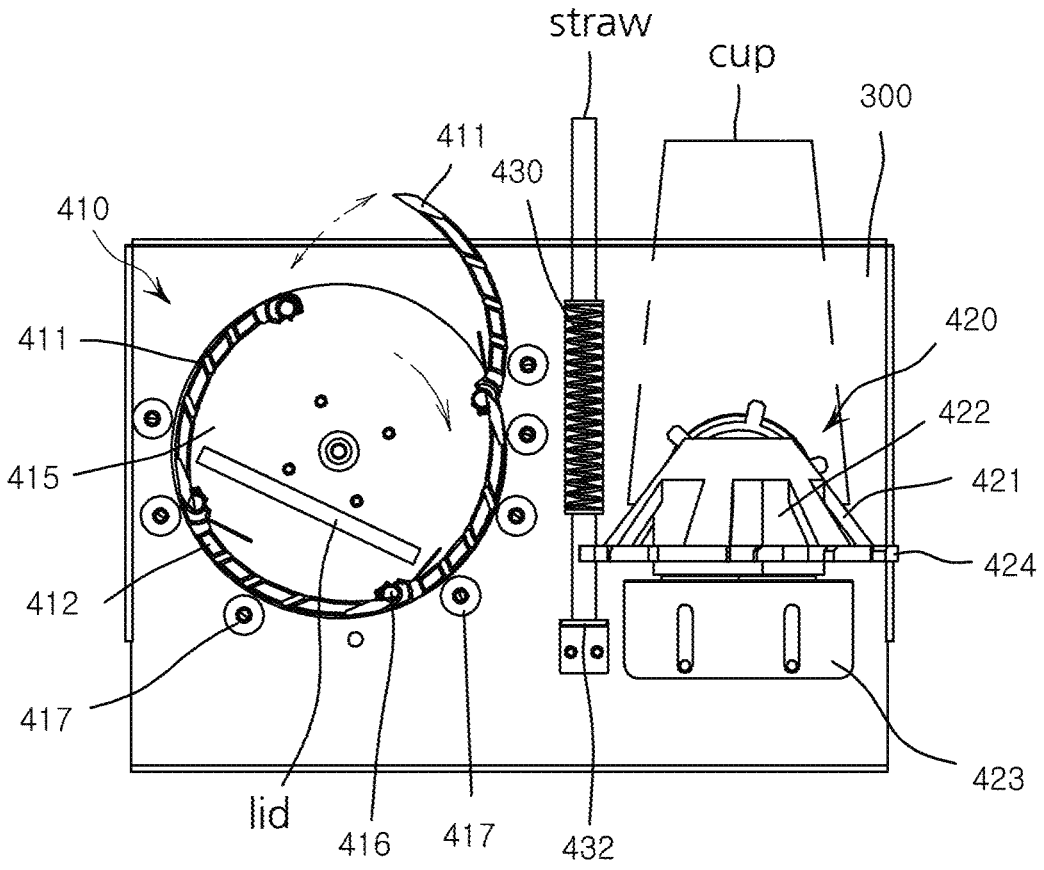
FIG. 11 is a cross-sectional view showing a state in which a lid, a straw, and a cup are mounted while a lid chamber of a cleaning unit is opened.
Figure 12:
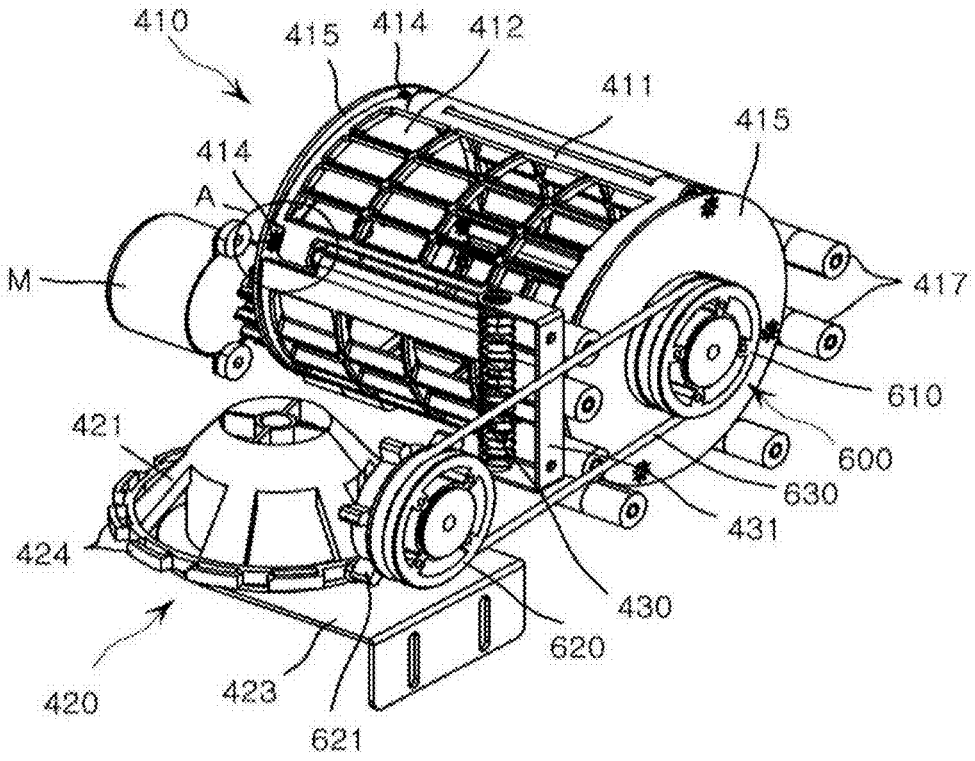
FIG. 12 is a perspective view showing main components in a state in which a lid chamber and a cup receiver in a cleaning unit are simultaneously operating by a power transfer means.
Figure 13:
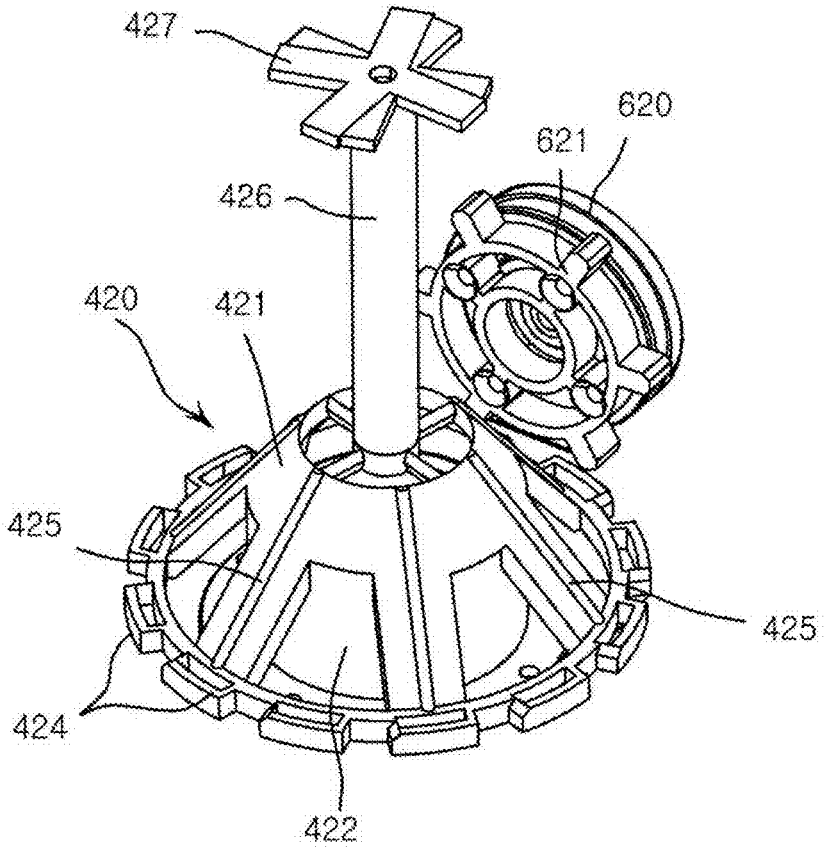
FIG. 13 is a perspective view illustrating main components in a state where a receiving protrusion is formed in a stand.
Figure 14:
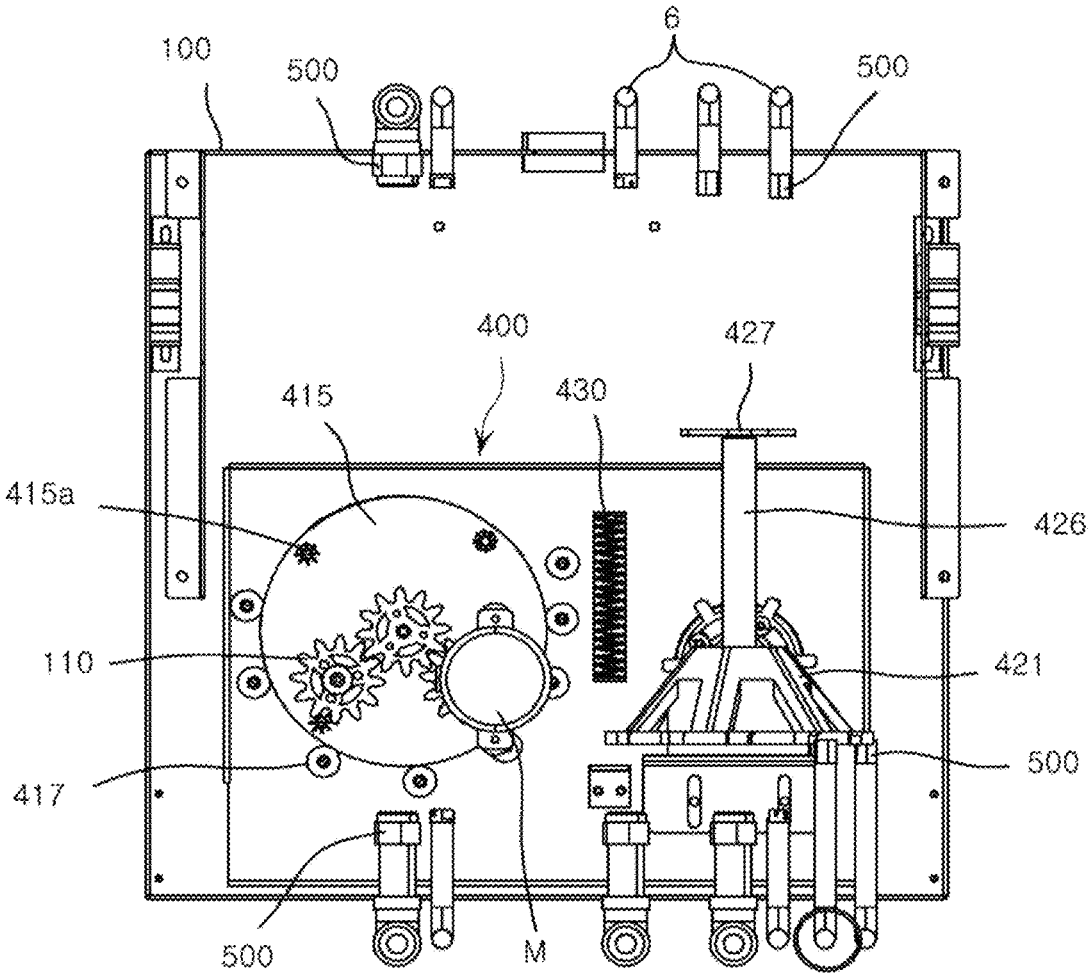
FIG. 14 is a longitudinal cross-sectional view of a housing, illustrating a state where one or more nozzles are disposed around a cleaning unit.
Figure 15:
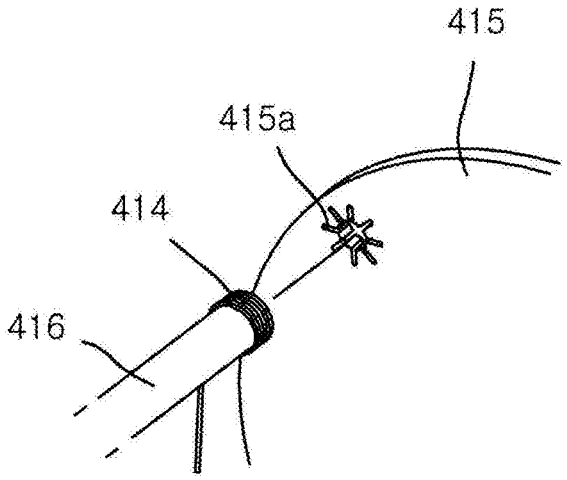
FIG. 15 is perspective view showing main components in a state in which locking grooves for adjusting elastic force of a torsion spring are formed in a support circular plate.
Figure 16:
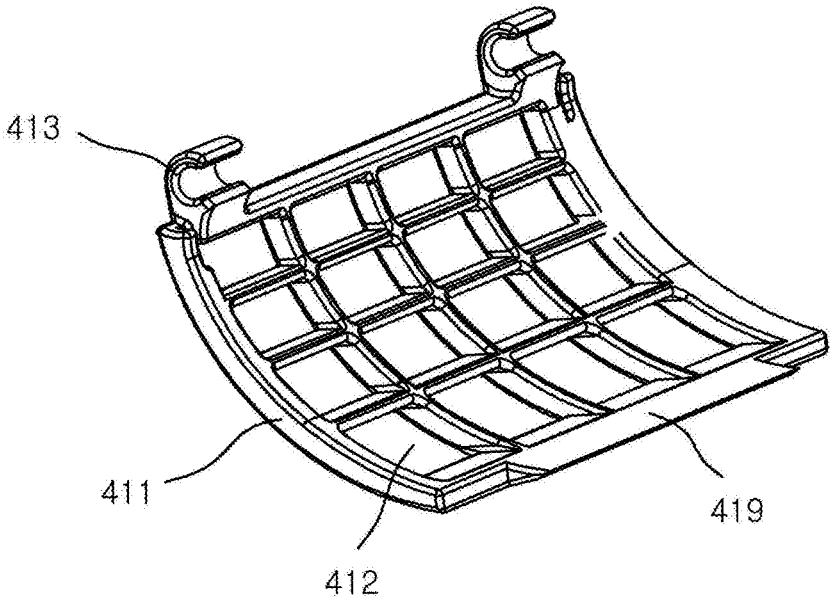
FIG. 16 is an expanded perspective view showing configurations of an openable plate.
Figure 17:
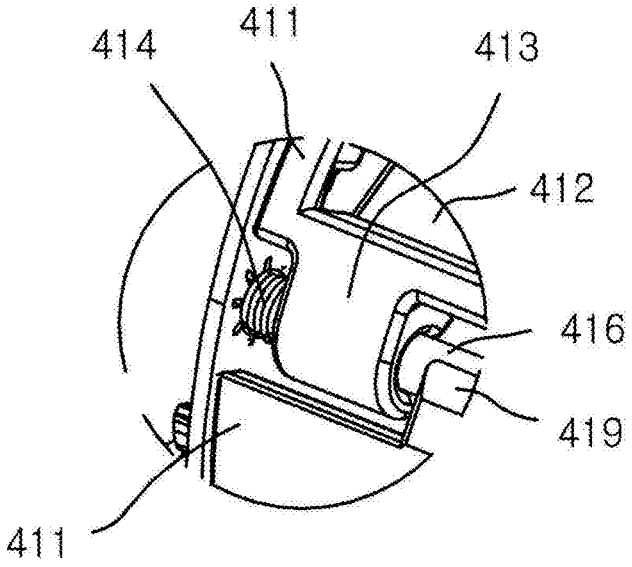
FIG. 17 is an expanded view of part A of FIG. 12.

Moreover, as shown in FIG. 11, a separate support plate 432 may be installed in a lower end of the coil spring 430 for inserting a straw to prevent the straw from falling and deviating from a cleaning position. As such, the straw is positioned as close to a lower portion of the cleaning unit 400 as possible through the support plate 432 such that a portion of the straw, which mostly contacts a mouth of the user, is intensively cleaned.

Figure 6:
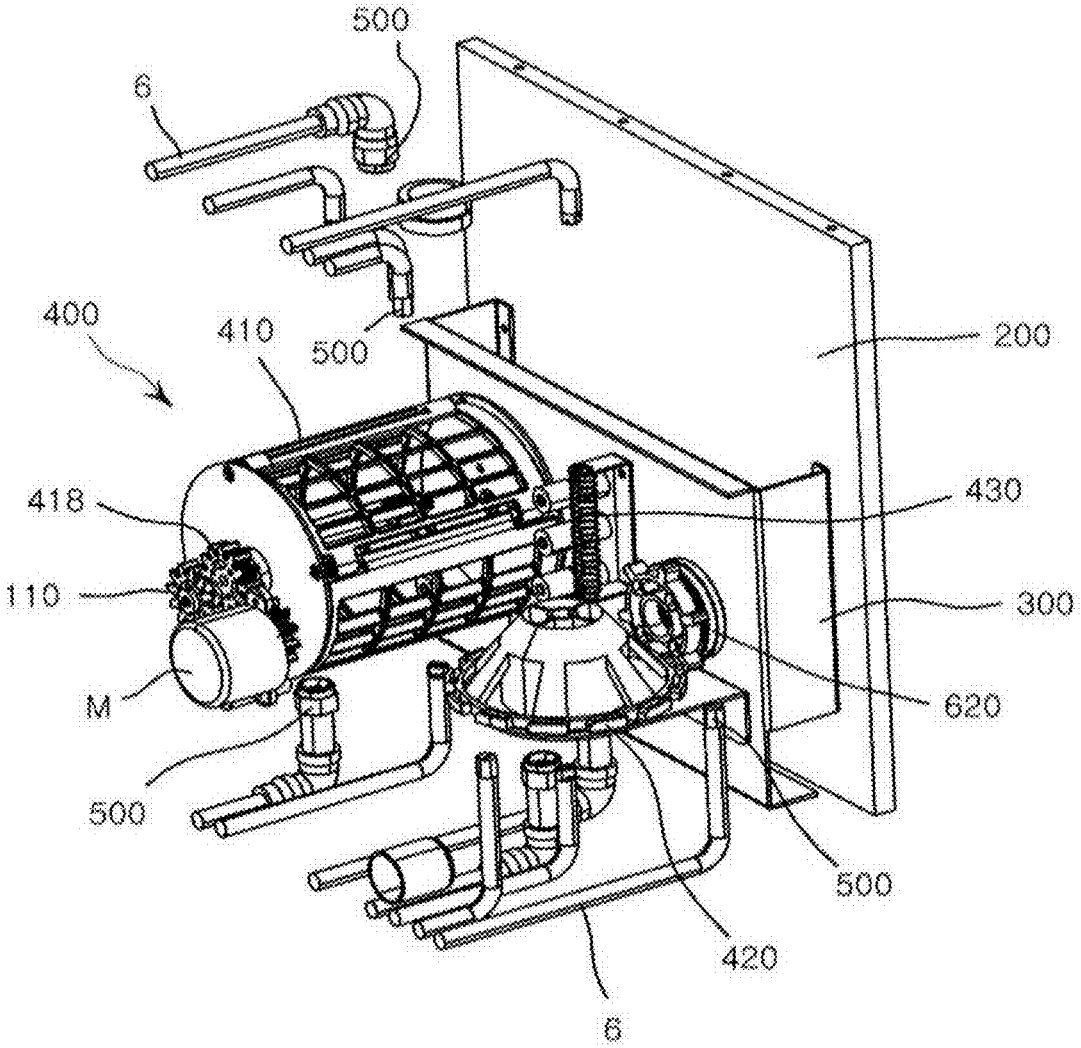
FIG. 6 is a perspective view showing main components in a state in which one or more nozzles are disposed in upper and lower portions of a cleaning unit attached to an inner side of a door through a bracket.
Figure 7:
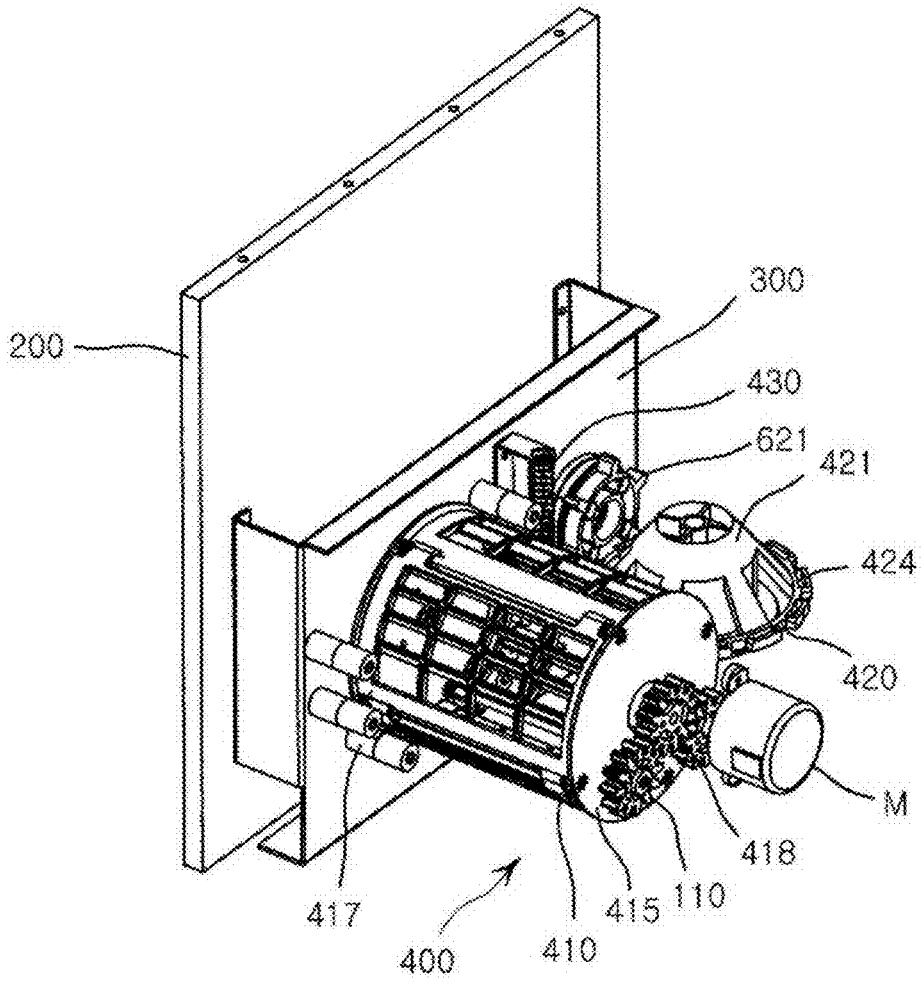
FIG. 7 is a perspective view showing main components without the one or more nozzles of FIG. 6.
Figure 8:
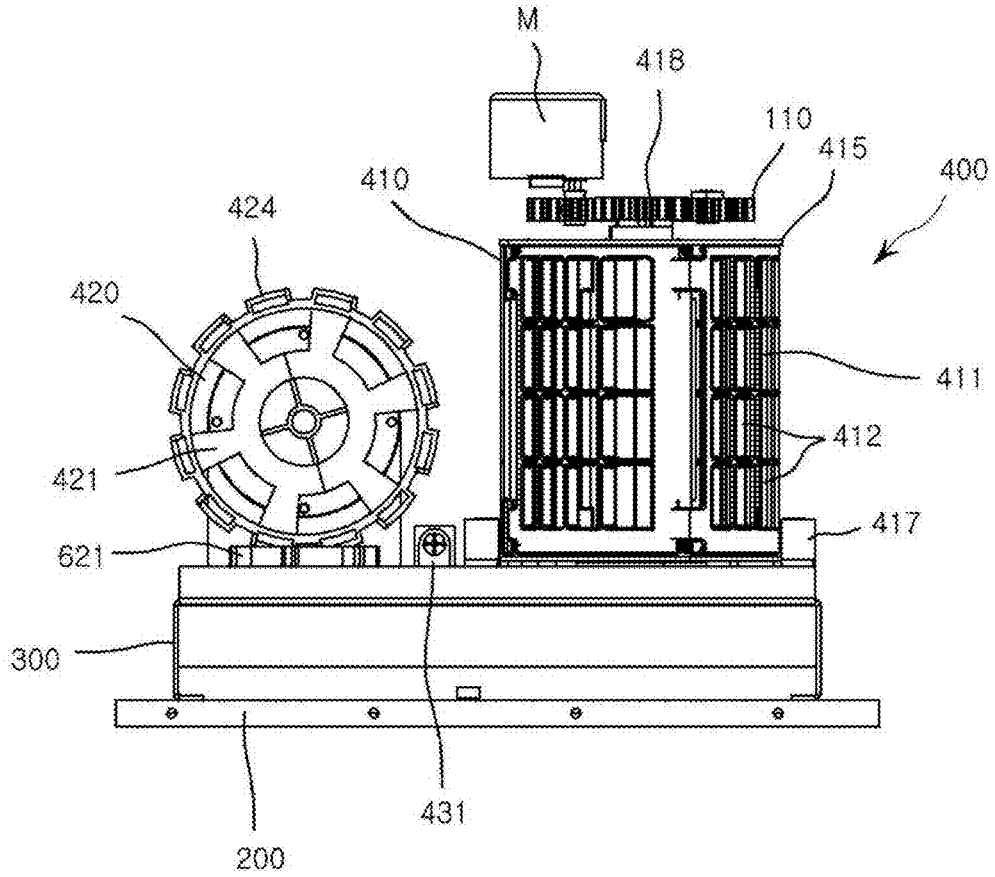
FIG. 8 is a plan view of FIG. 7.

FIG. 6 is a perspective view illustrating main components of the tumbler cleaner in a state where the one or more nozzles 500 spraying each of the washing water and the rinsing water are disposed in the lower and upper portions of the cleaning unit 400. FIG. 7 is a perspective view illustrating the cleaning unit 400 with the one or more nozzles 500 omitted.

The lid chamber 410 is a container designed to clean the lid of the tumbler. The lid chamber 410 is made by combining a plurality of openable plates 411 so as to form a drum shape at a side of the bracket 300, i.e., inside the housing 100 (Refer to FIG. 10). The lid chamber 410 is installed to freely rotate with respect to the bracket 300 through a bearing (not shown).

A drive motor M may be provided outside the housing 100. Power of the drive motor M may rotate the lid chamber 410 at a predetermined speed by transferring the power to a pinion 418 that is axially disposed at an outer side of the lid chamber 410 through an intermediate gear 110.

The drive motor M may stop rotating by cutting electricity when the door 200 is opened from the housing 100 using a point of contact of a switch that is not shown. When the door 200 is closed by the rotation of the user, the drive motor M operates by the point of contact of the switch in a state where an inner cleaning space of the housing 100 is closed. When the lid chamber 410 is rotated together with the pinion 418 in a direction where the door 200 is opened, the pinion 418 is separated from the intermediate gear 110 so that the power is cut off, as shown in FIG. 4. When the door 200 is again moved in a closing direction, the pinion 418 and the intermediate gear 110 are in gear engagement to transfer rotation power of the drive motor M to the lid chamber 410.

The lid chamber 410 may rotate by receiving power of the drive motor M arranged outside the housing 100 in a state where the housing 100 is closed by the closing operation of the door 200. The lid chamber 410 may rotate 360 degrees.

According to an embodiment, the lid chamber 410 may include two support circular plates 415, a plurality of hinge shafts 416, and the plurality of openable plates 411. The support circular plates 415 are opposingly disposed with respect to each other. The plurality of hinge shafts 416 are disposed between the two support circular plates 415. Each openable plate 411 in the plurality of openable plates 411 has an arc shape. Each openable plate 411 may be hingedly connected to respective hinge shaft 416 to be rotatable and may include a plurality of openings 412 to allow flows of the washing water and the rinsing water. The openable plate 411 may have a shape where the openings are repeatedly formed and may be manufactured by injection molding.

According to an embodiment, the openable plate 411 may be a quadrant arc shape. The lid chamber 410 may be formed as a cylinder by coupling four openable plates 411. Also, a hinge portion 413 coupled to the hinge shaft 416 may be provided at one side of each openable plate 411. A wing portion 419 contacting to an outer face of an adjacent hinge shaft 416 may be integrally formed at the other side of each openable plate 411.

The lid chamber 410 may be formed as a cylindrical (drum) shape by the plurality of the openable plates 411 connected to each other. Each openable plate 411 may be rotationally connected about the hinge shaft 416 between the opposing support circular plates 415.

Torsion springs 414 apply to each openable plate 411 constituting the cylindrical lid chamber 410 an elastic force in an opening direction of each openable plate 411. The openable plate 411 is coupled to the hinge shaft 416 such that the elastic force is exerted in the opening direction of the openable plate 411 by the torsion spring 414 disposed in the hinge shaft 416. Also, the openable plate 411 may be contacted by a plurality of guide rollers 417 fixedly positioned in the bracket 300 to stay closed at a location, except for at the upper portion of the door 200.

Figure 9:
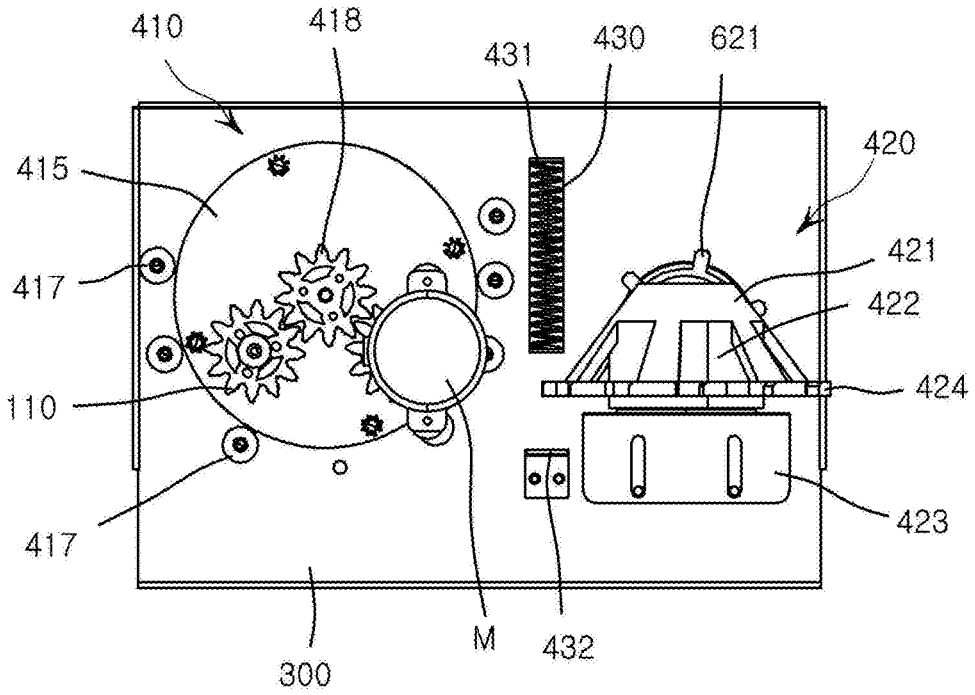
FIG. 9 is a rear view of FIG. 7.
Figure 10:
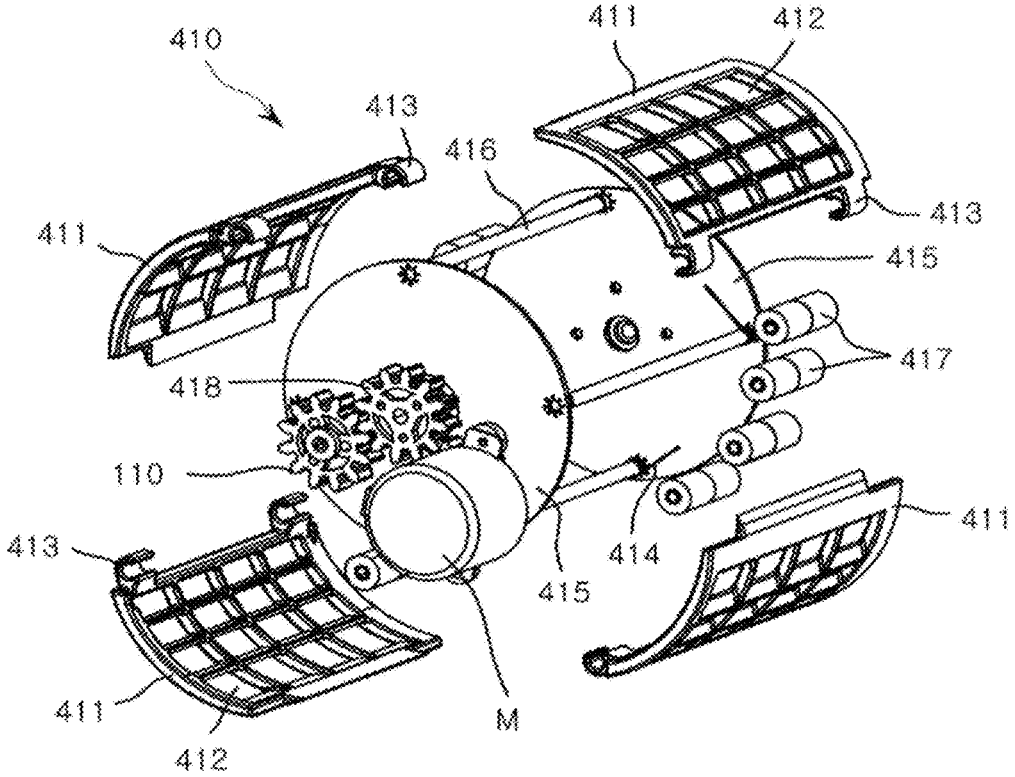
FIG. 10 is an exploded perspective view showing configurations of a lid chamber.

FIGS. 9 and 11 illustrate a state in which the plurality of guide rollers 417 fixed in the bracket 300 are placed on a circumference of the lid chamber 410. As illustrated in the drawings, the plurality of the guide rollers 417 are disposed around side portions of the lid chamber 410 and a lower circumference of the lid chamber 410, except for the upper portion of the lid chamber 410 when viewed from the front of FIG. 11. Accordingly, when the openable plate 411 is positioned in the upper portion of the lid chamber 410 while the lid chamber 410 rotates by the power of the drive motor M, the openable plate 411 in the upper portion of the lid chamber 410 automatically opens by the elastic force of the torsion springs 414 since no guide rollers 417 are present around the upper portion of the lid chamber 410 (Refer to FIG. 11). Also, when the lid chamber 410 further rotates, the openable plate 411 opened in the upper portion of the lid chamber 410 is closed by the plurality of the guide rollers 417 exerting a pressing force.

In addition, locking grooves 415*a* may be formed in each support circular plate 415. Each locking groove 415*a* may have multiple portions that are spaced apart in a circumferential direction of the locking groove 415*a* such that the elastic force may be adjusted based on a locking location of an end of the torsion springs 414. Therefore, when the openable plates 411 are assembled or opening operation of the openable plates 411 does not properly work by decreased elastic force of the torsion springs 414 used for a long period of time, the locking location of the end of the torsion springs 414 may be changed to an appropriate multiple portion in the multiple portions of the locking grooves 415*a* to adjust a magnitude of the elastic force.

The lid of the tumbler is inserted into the lid chamber 410. When the washing water and the rinsing water are sprayed at a pressure through the one or more nozzles 500 disposed at the upper and lower portions of the housing 100, washing and rinsing are performed (Refer to FIG. 14). The washing water and the rinsing water may be introduced into the lid chamber 410 through the plurality of openings 412 formed in the plurality of openable plates 411. The washing water and the rinsing water sprayed from the one or more nozzles 500 may be collected in the bottom of the housing 100 and may exit through a drain conduit 120.

The cup receiver 420 is disposed at one side of the lid chamber 410. The cup receiver 420 functions as a stand that receives the cup of the tumbler to wash and rinse the cup. The cup receiver 420 may be attached to the bracket 300 to rotate together with the door 200 when the door 200 is open, like the lid chamber 410.

The cup receiver 420 includes a mount member 421 having a shape of a circular cone. An upper portion of the mount member 421 has a diameter smaller than a lower portion of the mount member 421. The cup receiver 420 may be arranged to axially rotate in a direction perpendicular to a support body 423 attached to the bracket 300. The support body 423 may be formed by coupling a horizonal plate and a vertical plate as a shape of 'L,' for example. The cup receiver 420 may be disposed in a direction perpendicular to the horizontal plate.

In addition, gear teeth 424 may be formed along a circumference of the cup receiver 420 at a lower side of the cup receiver 420. To be illustrated, the gear teeth 424 may be formed along a circumference of the mount member 421 at a lower side of the mount member 421. The mount member 421 may include a plurality of drain holes 422. The plurality of drain holes 422 is provided to facilitate draining and remove remaining water. Moreover, a receiving protrusion 425 obliquely protrudes at an outer inclined face of the mount member 421. A space may be formed between the inclined face of the mount member 421 and the inner side of the tumbler cup mounted thereon. The receiving protrusion 425 may include a plurality of receiving protrusions 425 along the inclined face of the mount member 421.

The power transfer means 600 may include a first pulley 610, a second pulley 620, and a belt 630. The first pulley 610 is coupled to a side of the lid chamber 410. The second pulley 620 is disposed at one side of the cup receiver 420 to axially rotate in a direction perpendicular to a rotation direction of the cup receiver 420, and cogs 621 being in gear engagement with the gear teeth 424 are formed on an outer circumference of the second pulley 620. The belt 630 may be connected to each of the first pulley 610 and the second pulley 620 to transfer power.

In another embodiment, the mount member may have a step shape.

Consequently, the tumbler cleaner according to the present invention may wash and rinse any cups having different sizes and shapes based on manufacturers through the one or more nozzles 500 installed at the upper and lower portions of the housing 100 while the cup to be cleaned is mounted on the mount member 421 by inserting the cup into the cone-shaped mount member 421.

The cup receiver 420 may further include a support rod 426 and a cup support 427. The support rod 426 may be coupled to an upper center portion of the mount member 421. The cup support 427 may be coupled to an upper end of the support rod 426. The cup support 427 may be shaped as a cross. The cup support 427 may prevent the cup placed in the cup receiver 420 from excessively shaking or separating from the mount member 421 by water pressure when the washing water and the rinsing water are sprayed at a high pressure by the one or more nozzles 500.

The washing water may be supplied along a supply conduit 6 via a pump 5 from a tank 4 storing a cleaning liquid. The rinsing water may be directly connected to waterworks or a separate tank for storing the rinsing water. In the latter, the rinsing water stored in the separate tank may be sprayed by the one or more nozzles 500 at a predetermined water pressure through the pump and the supply conduit 6. When hot water is used as the washing water and the rinsing water, washing and rinsing effects may increase. As the circumference of the cup receiver 420 contacts a portion of the cup touched by the user the most, the circumference of the cup receiver 420 needs intensive cleaning relative to the other area of the cup receiver 420.

Therefore, the one or more nozzles 500 may be disposed around an inlet portion of the cup mounted on the cup receiver 420. The one or more nozzle 500 are designed to spray the washing water and the rinsing water toward a side portion of the inlet portion of the cup in an inclined direction. In addition, rotating the cup receiver 420 at a preset speed by transferring rotation force of the drive motor M via the power transfer means 600 may help foreign substances that may be attached to the circumference of the cup to uniformly be removed (Refer to FIGS. 12 and 13).

The second pulley 260 is provided with the cogs 621 that are coupled to the gear teeth 424 formed on the circumference of the cup receiver 420. When the lid chamber 410 rotates by the drive motor M, the cogs 621 of the second pulley 620 rotates through the power transfer means 600 in engagement with the gear teeth 424 of the cup receiver, which causes the cup receiver 420 to rotate at the preset speed.

As such, after cleaning and rinsing of the cup, the lid, and the straw, mounted on the cleaning unit 400, are completed, the drive motor M further operates for a preset amount of time. The further rotation of the drive motor M allows the lid chamber 410 and the cup receiver 420 to rotate at the preset speed, which may be preferably performed to shake off water remaining in the cup and the lid.

Accordingly, even for a cup having a concave recess, because of very little water remaining by the process of shaking off the remaining water and the structure in which the one or more nozzles 500 diagonally spray water in directions crossing each other, the cup cleaned by the tumbler cleaner according to the present invention can be used right away to hold a beverage.

A disinfection lamp L for disinfecting the cup, lid, and the straw during the washing and rinsing processes may be further provided inside the housing 100. The disinfection lamp L may be an ultraviolet light or be a light emitting diode (LED). The disinfection lamp L performs disinfection by being turned on while the cup, the lid, and the straw are being washed and rinsed through the one or more nozzles 500 in state where the opening of the housing 100 is closed by the door 200. Also, the disinfection lamp L is turned off through disengagement of a switch, right when the washing and rinsing is finished and the door 200 is opened to receive a new tumbler for cleaning.

At least one or more housings 100 may be installed in a multi-level frame 1 having a cabinet structure. In addition, a sink bowl 2 may be further provided at one side of the frame 1. The user may get rid of contents remaining in the cup, wash hands of the user, or the like.

According to the present invention, when the door 200 is opened, the lid chamber 410, the cup receiver 420, and the coil spring 430 for inserting a straw rotate together in an opening direction of the door 200 to allow a tumbler to be mounted or separated. The moment the door 200 is closed, washing, rinsing, disinfection, and discharging remaining water are automatically and rapidly performed step-by-step by a sensor or switch.

Therefore, according to the present invention, all of a cup, a lid, and a straw may be cleanly and automatically cleansed such that the cup, the lid, and the straw are ready for use, thereby allowing the user to drink a beverage in a clean and hygienic condition.

In an embodiment, a water collector may be installed below the lid chamber 410 and the cup receiver 420 in the cleaning unit 400 and the coil spring 430 for inserting a straw, respectively, to prevent dripping water.

Particularly, the present invention as described above is provided with a unit for cleaning a cup, a lid, and a straw, attached to a door, such that a washed tumbler is removed when the door is opened, and then when the door is closed after a new tumbler to be washed is mounted, automatic washing, rinsing, remaining water removal, and disinfection are performed.

A plurality of the tumbler cleaners having the foregoing functions in a state in which the plurality of the tumbler cleaners is arranged in a frame having a cabinet structure is installed in public facilities or stores specializing in selling drinks, allowing a user to automatically clean all of the cup, the lid, and the straw right before obtaining a drink.

In particular, since the washing water or rinsing water is diagonally sprayed to cross therewith, remaining water is minimized by a pressure of the sprayed water, thereby leading to more hygienic washing and rinsing.

Therefore, the present invention can be hygienic and increase the promotional and sales effect by improved service, and use of disposable cups can be avoided, thereby preventing environmental pollution and providing economic benefits.

Moreover, injury or discomfort that is caused by hot water remaining on a ceiling inside a housing and falling onto a hand, may be prevented, and no water remains in a cup, providing both excellent safety and convenience.

As described above, the present invention is explained with reference to embodiments illustrated in the drawings. However, this is only to explain the present invention. One having ordinary skill in the art will understand various modifications and equivalent embodiments are possible in light of the detailed description of the invention.

What is claimed is:

1. A tumbler cleaner comprising:

a housing;

a door coupled to a front opening of the housing;

a bracket attached to an inner side of the door;

a cleaning unit coupled to the bracket and cleaning each of a cup and a lid of a tumbler; and one or more nozzles disposed in at least one of an upper portion and lower portion of the housing to spray washing water and rinsing water toward the cleaning unit, wherein the cleaning unit includes:

a lid chamber accommodating the lid of the tumbler; and a cup receiver, wherein the cup of the tumbler is mounted on the cup receiver, wherein the lid chamber and the cup receiver operate in conjunction with each other by a power transfer means.

2. The tumbler cleaner of claim 1, wherein the cup receiver is arranged in a support body attached to the bracket to axially rotate in a direction perpendicular to the support body, and wherein gear teeth are formed on a lower outer circumferential face of the cup receiver along a circumferential direction of the cup receiver.

3. The tumbler cleaner of claim 2, wherein the power transfer means includes:

a first pulley coupled at one side of the lid chamber;

a second pulley disposed at one side of the cup receiver to be axially rotatable in a direction perpendicular to a rotation direction of the cup receiver, wherein cogs being in gear engagement with the gear teeth are formed on a circumferential face of the second pulley; and a belt connected to each of the first pulley and the second pulley to transfer power.

4. The tumbler cleaner of claim 1, wherein the cleaning unit further includes a coil spring for inserting a straw, vertically disposed by a support fixture coupled to the bracket.

5. The tumbler cleaner of claim 1, wherein the lid chamber includes:

two support circular plates disposed to face with each other;

a plurality of hinge shafts disposed between the two support circular plates; and a plurality of openable plates, each having an arc shape, wherein the plurality of openable plates is hingedly coupled to the plurality of hinge shafts to be rotatable, and wherein a plurality of openings is formed to allow a flow of the washing water and the rinsing water into the plurality of openable plates.

6. The tumbler cleaner of claim 1, wherein the cup receiver includes a mount member having a cone shape, wherein a diameter of an upper end portion of the mount member is smaller than a diameter of a lower end portion of the mount member, wherein gear teeth are formed on a lower circumference of the mount member along a circumferential direction of the mount member, and wherein a plurality of drain holes is formed in the mount member.

7. The tumbler cleaner of claim 6, wherein a receiving protrusion obliquely protrudes from an outer inclined surface of the mount member to form a space between the inclined surface and an inner surface of the cup of the tumbler mounted thereon.

8. The tumbler cleaner of claim 6, wherein the cup receiver further includes:

a support rod coupled to an upper center portion of the mount member; and a cup support coupled to an upper end of the support rod.

* * * * *